US011808016B2

(12) United States Patent
Amat Holgado et al.

(10) Patent No.: US 11,808,016 B2
(45) Date of Patent: Nov. 7, 2023

(54) BUCKET LIP FOR EARTH MOVING MACHINES

(71) Applicant: Metalogenia Research & Technologies S.L., Barcelona (ES)

(72) Inventors: Carlos Amat Holgado, Premià de Dalt (ES); Albert Gimeno Tordera, Barcelona (ES); Jorge Triginer Boixeda, Barcelona (ES)

(73) Assignee: Metalogenia Research & Technologies S.L., Barcelona (ES)

( * ) Notice: Subject to any disclaimer, the term of this patent is extended or adjusted under 35 U.S.C. 154(b) by 670 days.

(21) Appl. No.: 16/634,177

(22) PCT Filed: Jul. 27, 2017

(86) PCT No.: PCT/ES2017/070545
§ 371 (c)(1),
(2) Date: Jan. 27, 2020

(87) PCT Pub. No.: WO2019/020844
PCT Pub. Date: Jan. 31, 2019

(65) Prior Publication Data
US 2020/0232193 A1 Jul. 23, 2020

(51) Int. Cl.
*E02F 9/28* (2006.01)
*E02F 3/40* (2006.01)

(52) U.S. Cl.
CPC ..... *E02F 9/2816* (2013.01); *E02F 3/401* (2013.01)

(58) Field of Classification Search
CPC ..... E02F 3/401; E02F 3/815; E02F 9/2816; E02F 9/2883
See application file for complete search history.

(56) References Cited

U.S. PATENT DOCUMENTS

| | | | | |
|---|---|---|---|---|
| 4,043,060 | A * | 8/1977 | Stepe | E02F 9/2841 37/446 |
| 6,751,897 | B2 * | 6/2004 | Bierwith | E02F 9/2883 37/446 |
| 6,990,760 | B1 | 1/2006 | Zaayman et al. | |
| D631,490 | S * | 1/2011 | Drager | D15/32 |
| D678,361 | S * | 3/2013 | Attwood | D15/32 |
| 8,959,806 | B2 * | 2/2015 | Zamorano Jones | E02F 9/2825 37/453 |
| 9,260,839 | B2 * | 2/2016 | Kunz | E02F 9/2883 |

(Continued)

FOREIGN PATENT DOCUMENTS

| | | |
|---|---|---|
| WO | WO 2011/075782 | 6/2011 |
| WO | WO 2019/020844 | 1/2019 |

OTHER PUBLICATIONS

Informe de Busqueda Internacional [International Search Report] dated Mar. 28, 2018 From the International Searching Authority Re. Application No. PCT/ES2017/070545 and Its Translation of Search Report and Written Opinion Into English. (10 Pages).

*Primary Examiner* — Gary S Hartmann

(57) ABSTRACT

A bucket lip for earth moving machines includes a front blade (1) provided with a plurality of projections (2) for placing a plurality of teeth; a plurality of front cavities (3) placed between said projections (2) for placing a plurality of front guards; and a plurality of tension elements (4) for distributing the stress produced while using the bucket; wherein said tension elements (4) are arranged between said projections (2), after said front cavities (3).

9 Claims, 5 Drawing Sheets

(56) References Cited

U.S. PATENT DOCUMENTS

| | | | | | |
|---|---|---|---|---|---|
| D769,946 | S | * | 10/2016 | Kunz | D15/32 |
| D790,608 | S | * | 6/2017 | Kunz | D15/32 |
| D797,162 | S | * | 9/2017 | Kunz | D15/32 |
| 9,970,181 | B2 | * | 5/2018 | Kunz | E02F 3/60 |
| 10,774,499 | B2 | * | 9/2020 | Ollinger, IV | E02F 3/40 |
| 2013/0318840 | A1 | | 12/2013 | Ollinger, IV et al. | |

* cited by examiner

BUCKET LIP FOR EARTH MOVING MACHINES

RELATED APPLICATION

This application is a National Phase of PCT Patent Application No. PCT/ES2017/070545 having International filing date of Jul. 27, 2017. The contents of the above application is incorporated by reference as if fully set forth herein in its entirety.

FIELD AND BACKGROUND OF THE INVENTION

The present invention relates to a bucket lip for earth moving machines, for example, for excavators or loaders for construction and mining work, or the like.

It is common to use earth moving machines, such as excavators or loaders, for example, for construction work, mining work, etc. These machines generally comprise a bucket or shovel where the material is collected. This bucket is subjected to high stress and tremendous wear, primarily in the front area, commonly referred to as a blade. For this reason in general, these blades usually have a plurality of built-in protective or wear elements.

These protective elements include:

- teeth: serving to penetrate the soil and protect the blade of the bucket;
- tooth bar: serving to protect the blade and hold the teeth;
- front guards: serving to protect the lip in the areas comprised between the teeth and to also perform the penetration function, but to a lesser extent than the teeth;
- side guards: protect the sides of the bucket.

All these elements, normally referred to together as protective or wear elements, are subjected to high mechanical stressing, plastic straining and intense wear. For this reason, it is common to have to replace these elements every so often when the wear sustained so requires.

The protective or wear elements can be fixed through mechanical means or be welded, depending on the degree of soil abrasiveness and the dimensions of the machine. If these elements are fixed through mechanical means, they can be changed more easily and more quickly, whereas if they are welded they are less expensive but harder to change and present the risk of the blade being damaged due to the weld.

According to blade thicknesses, they are manufactured either by rolling or by casting, for example, blades smaller than 140-160 mm are rolled and larger blades are made by casting.

In blades made by casting, the adapter is also made by casting. The reason for using different types of systems for manufacturing the blades according to thickness is because with rolling, thicknesses greater than 140-160 mm do not provide for the wear resistance or the flexibility that are required. With such large thicknesses, very heavy and rigid blades are produced.

In the event of working stress, the front part of the blade deteriorates and has to be repaired or rebuilt, for which purpose the machine has to be stopped, increasing the operating cost and reducing machine productivity.

To find a balance between bucket resistance and bucket weight, it is common to form cavities and tension elements therein. These cavities, for example, are used to house the front guards, and the tension elements are usually placed in the bucket right behind the projections in order to transmit the stress while using the earth moving machine.

An object of the present invention is to provide a bucket for earth moving machines that optimizes the distribution of stress caused while using the machine, improving resistance and reducing the need for repairs and rebuilding.

In addition to said optimization of the distribution of stress, another object is to provide a bucket for earth moving machines the weight of which is as low as possible, while maintaining or improving resistance.

SUMMARY OF THE INVENTION

The bucket lip for earth moving machines of the invention helps to solve the aforementioned drawbacks and has other advantages that will be described below.

The bucket lip for earth moving machines according to the present invention comprises:

- a front blade provided with a plurality of projections (which can also be referred to as cast-noses) for placing a plurality of teeth;
- a plurality of front cavities placed between said projections for placing a plurality of front guards; and
- a plurality of tension elements for transmitting the stress produced while using the bucket;

and characterized in that said tension elements are arranged between said projections, after said front cavities.

In other words, the object of the present invention is to remove a large quantity of material behind the projections (which is the heaviest area) and to keep material (tension elements) behind the front cavities, although the geometry of said tension elements and said cavities may not be precise due to manufacturing and hardness issues.

As a result of this arrangement of the tension elements, the distribution of stress while using the machine is optimized, obtaining a more flexible bucket and subjecting said bucket to less fatigue, such that it requires fewer repair tasks.

According to a preferred embodiment, said tension elements are arranged in the lower part of the bucket, and furthermore the lower part of the bucket can comprise second cavities between which said tension elements are defined.

Advantageously, the lip according to the present invention comprises inner tension elements and outer tension elements having different shapes. The term "outer tension elements" is used to indicate the tension elements located closer to the ends of the bucket, whereas the term "inner tension elements" refers to the remaining tension elements that are not close to the ends of the bucket.

For example, the inner tension elements are substantially rectangular and the outer tension elements are trapezoid-shaped, with their widest side facing the front cavities.

Said front cavities preferably extend in the upper and rear part of the bucket.

According to a preferred embodiment, said front cavities in the front part of the bucket lip are defined by three planar faces. For example, said planar faces comprise a central face and two side faces, wherein the central face is substantially rectangular-shaped and the side faces are trapezoid-shaped.

To make it easier for the bucket lip to penetrate the soil and to be repaired, the upper area of the bucket between the front cavities is substantially planar.

BRIEF DESCRIPTION OF THE SEVERAL VIEWS OF THE DRAWINGS

To better understand the preceding description, drawings in which a practical embodiment is schematically depicted only by way of non-limiting example are attached.

DESCRIPTION OF SPECIFIC EMBODIMENTS OF THE INVENTION

Figure 1:
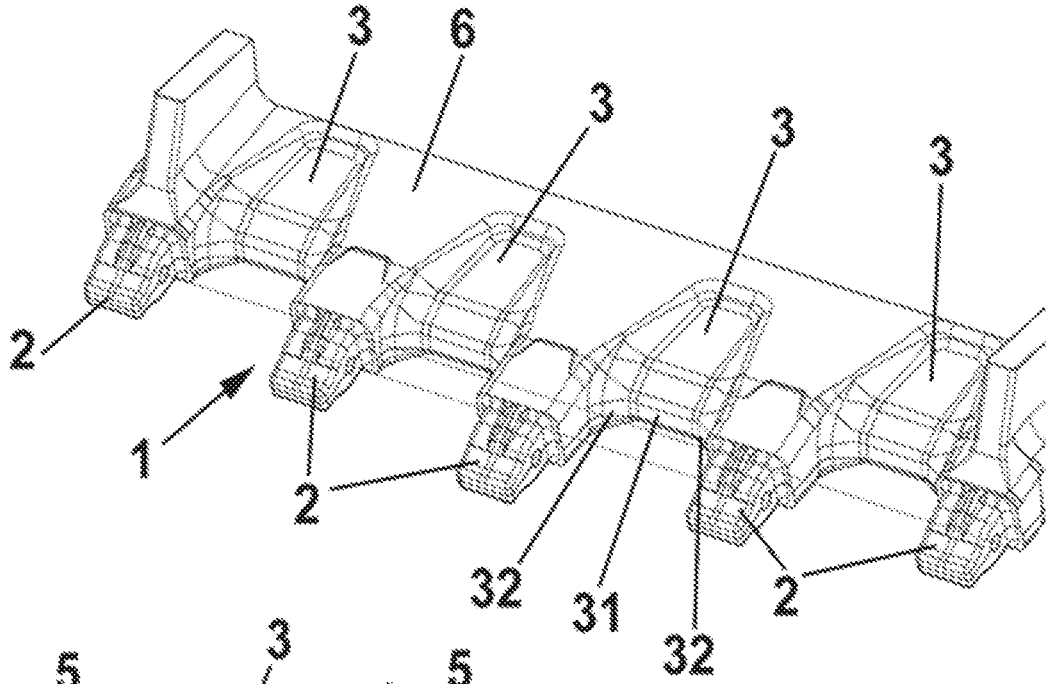
FIG. 1 is a top perspective view of the bucket lip for earth moving machines according to the present invention.

As is shown in the drawings, the bucket lip for earth moving machines according to the present invention comprises a front blade 1 defined on the front edge of the bucket lip, provided with a plurality of projections 2, also commonly known as cast-noses, for placing respective teeth (not depicted in the drawings as they are known and conventional).

Furthermore, the lip also comprises front cavities 3 for placing respective front guards (not depicted in the drawings as they are known and conventional).

The teeth and front guards are known as protective and wear elements, and they are removed and replaced when needed.

According to the depicted embodiment, said front cavities 3 extend in the upper part and the lower part of the bucket, and when the front guards are put in place they prevent such guards from projecting substantially from the bucket.

The bucket lip according to the present invention also comprises a plurality of tension elements 4, which are what primarily distribute the stress produced while using the bucket. These tension elements 4 are arranged between projections 2, after the front cavities 3, i.e., behind said front cavities 3, taking into account that the projections 2 are placed in the front part of the bucket.

In the depicted embodiment, said tension elements 4 are arranged in the lower part of the bucket and are defined between a plurality of second cavities 5. The object of these second cavities 5 is to reduce the weight of the bucket, favoring lower fuel consumption when using the machine.

Figure 2:
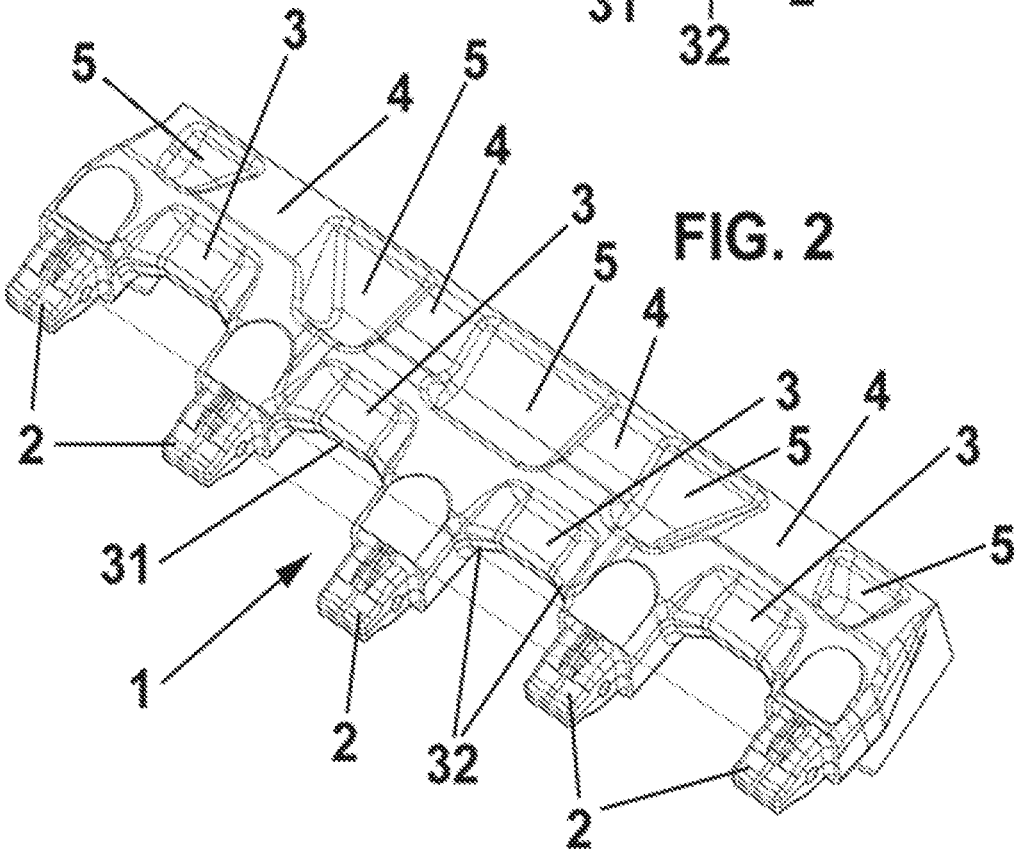
FIG. 2 is a bottom perspective view of the bucket lip for earth moving machines according to the present invention.
Figure 3:
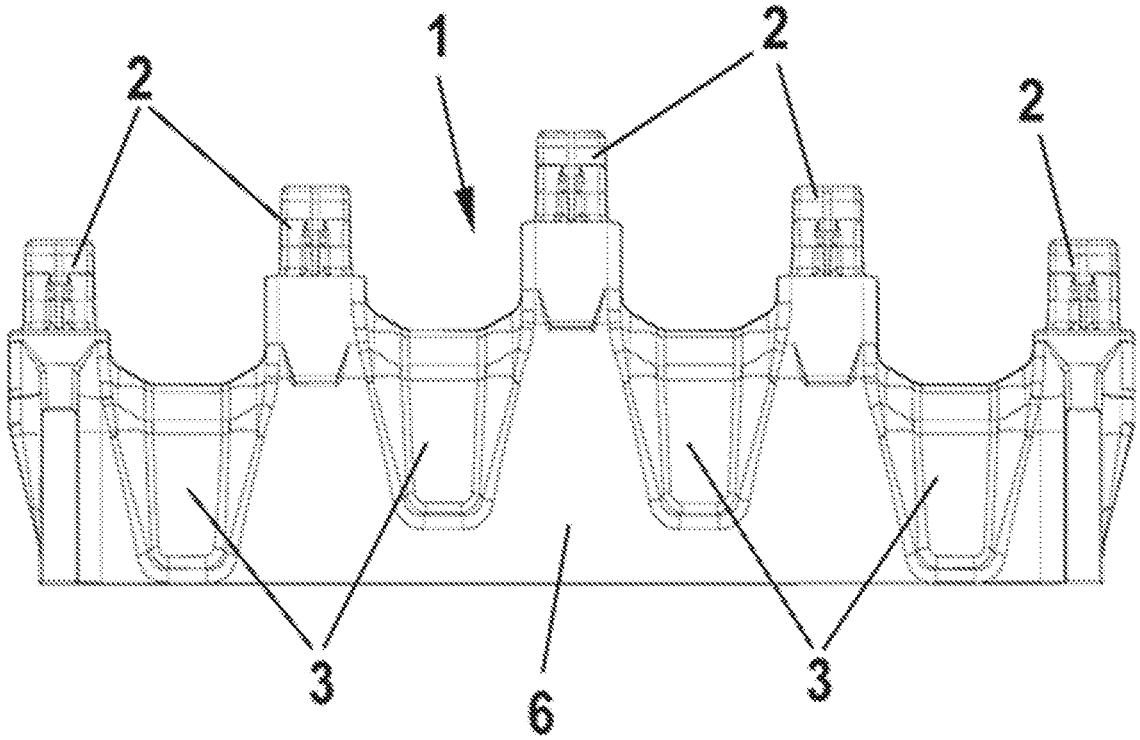
FIG. 3 is a top plan view of the bucket lip for earth moving machines according to the present invention.
Figure 4:
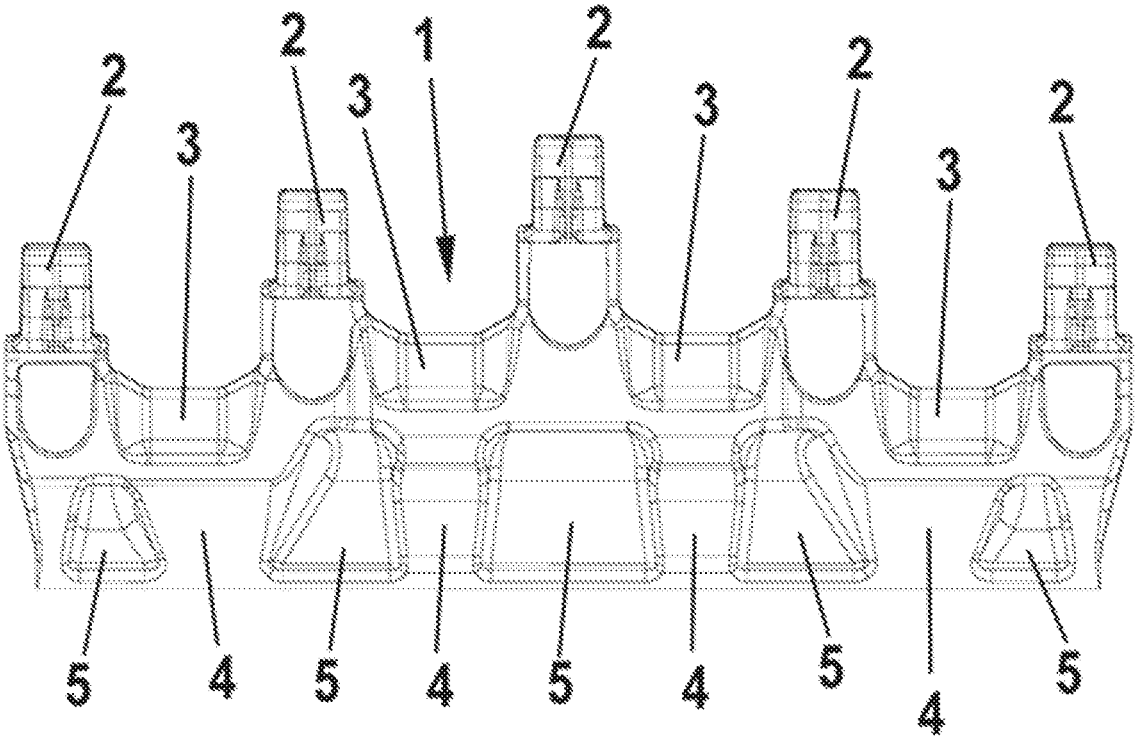
FIG. 4 is a bottom plan view of the bucket lip for earth moving machines according to the present invention.

It should be indicated that the dimensions and shapes of these tension elements 4 will be established according to the stress the bucket must withstand and to the position thereof. For example, as can be seen in FIGS. 2 and 4, the inner tension elements are substantially rectangular, whereas the outer tension elements are trapezoid-shaped, with their widest side facing the front cavities 3. The shape of the tension elements is a result of trying to cover the rear part of the front cavities 3, but with the rule that the second cavities 5 have to be as large as possible in order to find a balance between blade resistance and the process of manufacturing said blades.

Figure 5:
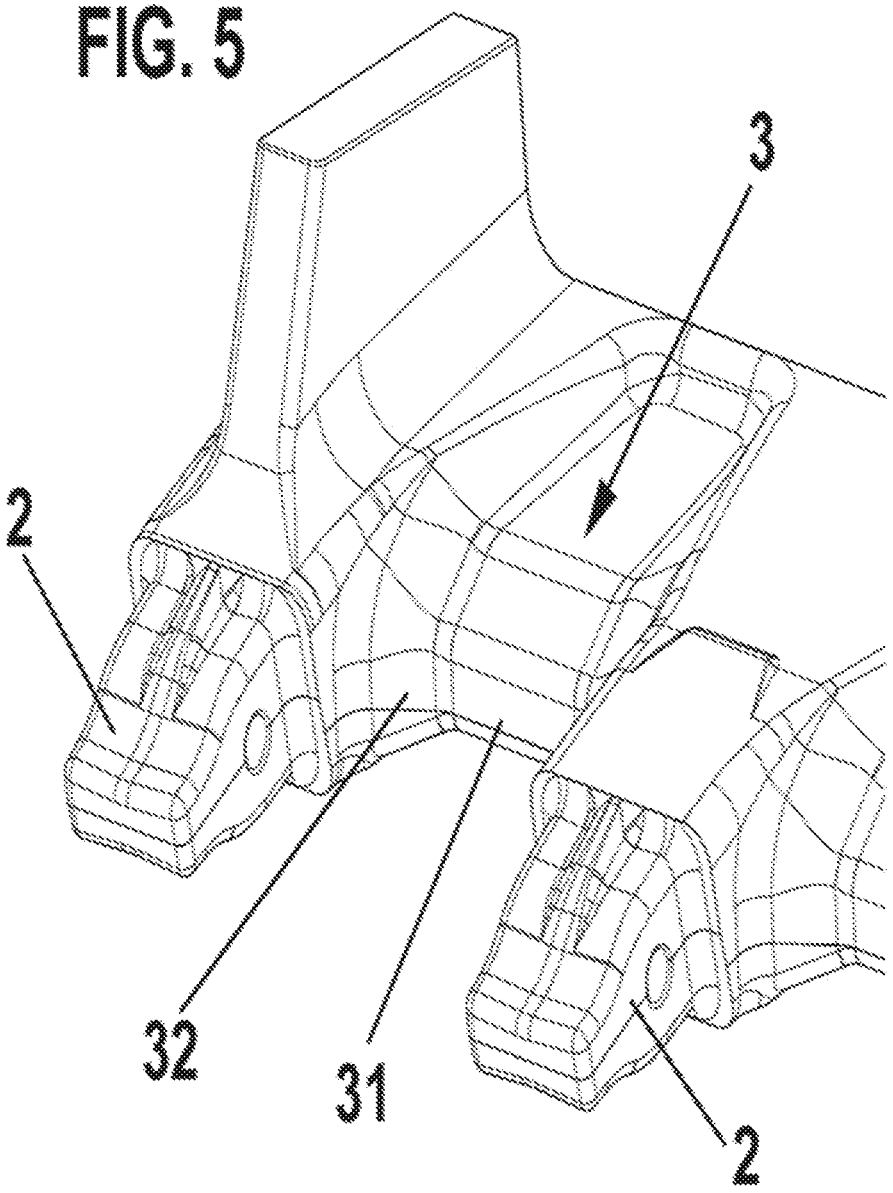
FIG. 5 is a top perspective view of a detail of the bucket lip for earth moving machines according to the present invention.

As can be seen in greater detail in FIG. 5, each front cavity 3 is defined by three planar faces: a central face 31 and two side faces 32 on the front part. The two side faces 32 are tilted with respect to the central face 31, defining an obtuse angle with said central face 31. The geometry of those front cavities 3 is one that is suitable for receiving the front guard, in fact, these cavities are made to reduce weight, as discussed above, but also to prevent the guard from projecting out of the projections, and they are thereby protected from wear. The geometry of these faces also has the function of reducing and improving the distribution of stress.

According to the depicted embodiment, the central face 31 is substantially rectangular and the side faces 32 are trapezoidal, although they could have any suitable shape.

This configuration of the front cavities 3 allows providing a larger contact surface between the front part of the blade and the guard, minimizing wear and making repair thereof easier. The purpose is to increase said front contact area of the blade to reduce relative movement between the guard and the blade, said relative movement being what causes the inner wear of the contact areas.

Furthermore, to make it easier to perform repair and rebuilding tasks on the bucket according to the present invention, the upper area 6 of the bucket between the front cavities 3 is substantially planar.

Figure 6:
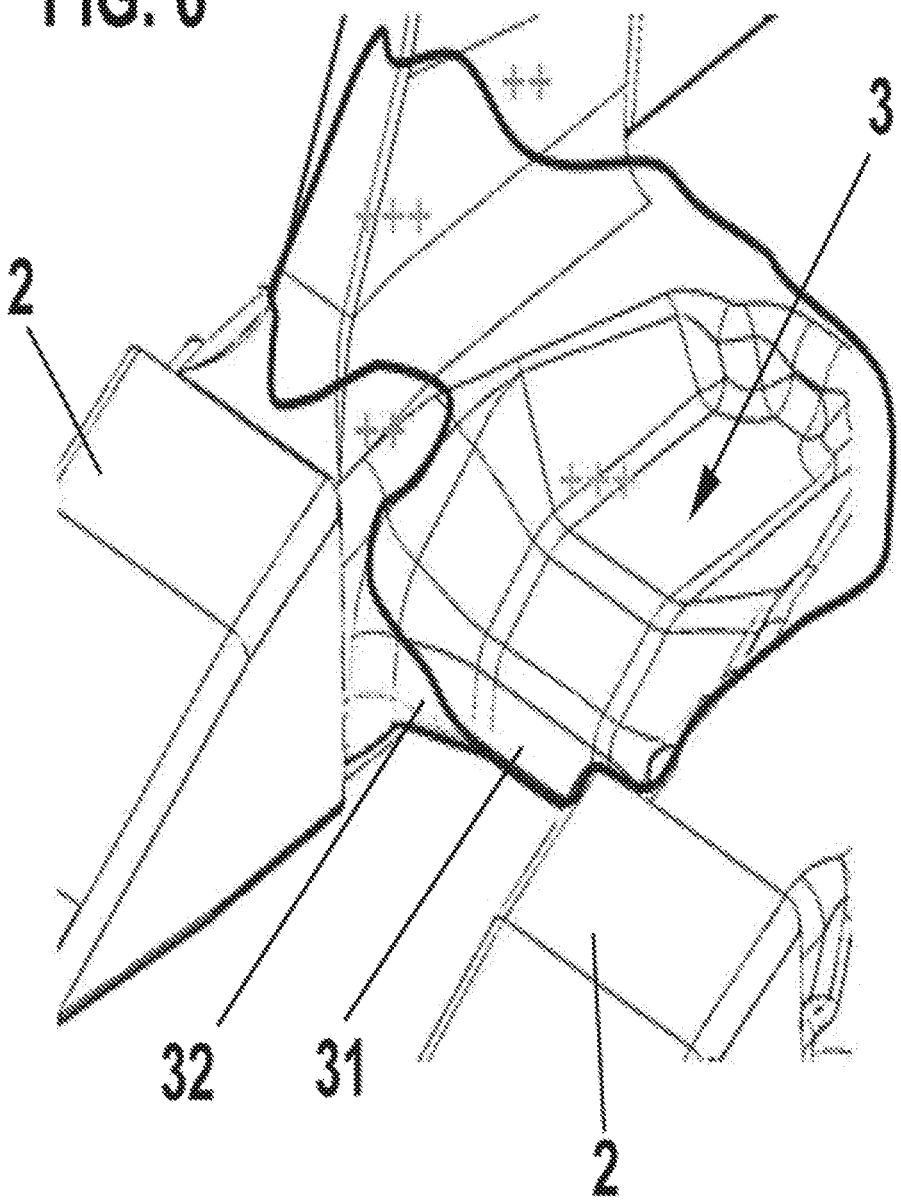
FIGS. 6 and 7 are perspective and plan views of the bucket lip according to the present invention, where the accumulation of stress while using the earth moving machine is depicted.
Figure 7:
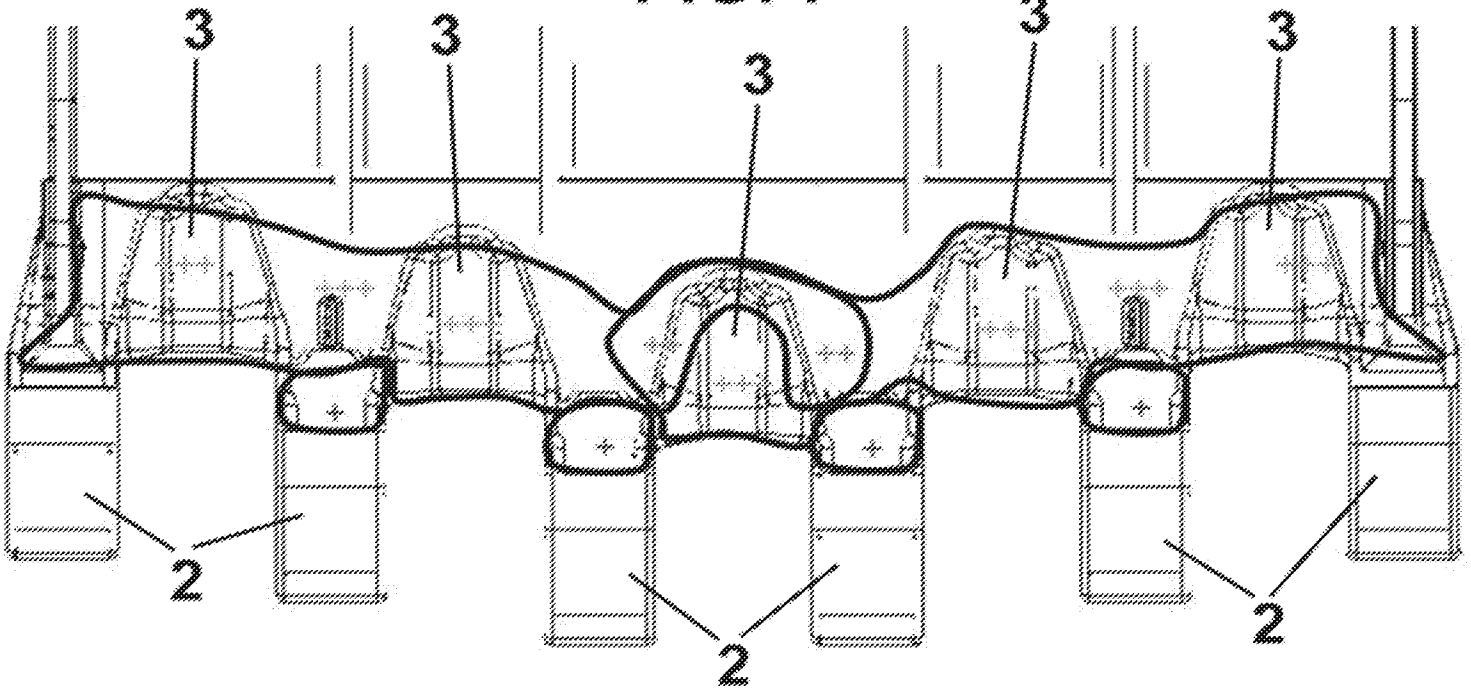

The purpose of FIGS. 6 and 7 is to depict the accumulation of stress while using the earth moving machine. To that end, "+" symbols are indicated in areas where more stress accumulates, and the more "+" symbols there are, the greater the stress accumulating in that area. Therefore, those areas with "+++" are the areas with the highest accumulation of stress.

As a result of arranging tension elements 4 between projections 2, and not in alignment with the projections as is conventional in the prior art, better distribution of the stress is achieved, making the bucket more flexible and less sensitive to fatigue. Although reference has been made to a specific embodiment of the invention, it is obvious for a person skilled in the art that the bucket lip described for earth moving machines is susceptible to a number of variations and modifications, and all the aforementioned details can be replaced with other technically equivalent ones without departing from the scope of protection defined by the attached claims.

What is claimed is:

1. A bucket lip of a bucket for earth moving machines, comprising:

a front blade provided with a plurality of projections for placing a plurality of teeth;

a plurality of front cavities positioned in between the plurality of projections, wherein the cavities are configured for attachment to a plurality of front guards; and a plurality of tension elements for distributing stress produced while using the bucket, wherein the tension elements are arranged between the projections and after the front cavities, and wherein the plurality of tension elements includes a plurality of inner tension elements and a plurality of outer tension elements;

wherein the plurality of outer tension elements are trapezoid-shaped with a widest side facing the front cavities and the the plurality of inner tension elements are rectangular-shaped.

2. The bucket lip of claim 1, wherein the tension elements are arranged in a lower part of the bucket.

3. The bucket lip of claim 1, wherein a lower part of the bucket comprises second cavities positioned between the tension elements.

4. The bucket lip of claim 1, wherein the front cavities extend in an upper and a rear part of the bucket.

5. The bucket lip of claim 1, wherein the front cavities in a front part of the bucket are defined by a plurality of planar faces.

6. The bucket lip of claim 5, wherein the three planar faces comprise a central face and two side faces.

7. The bucket lip of claim 6, wherein the central face is substantially rectangular-shaped.

8. The bucket lip of claim 6, wherein the two side faces are trapezoid-shaped.

9. The bucket lip of claim 1, wherein an upper area of the bucket between the front cavities is substantially planar.

* * * * *